US010109228B2

(12) United States Patent
Hoffman et al.

(10) Patent No.: US 10,109,228 B2
(45) Date of Patent: Oct. 23, 2018

(54) METHOD AND APPARATUS FOR HDR ON-DEMAND ATTENUATION CONTROL

(71) Applicant: SAMSUNG DISPLAY CO., LTD., Yongin, Gyeonggi-Do (KR)

(72) Inventors: David M. Hoffman, Fremont, CA (US); David Zamora, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 19 days.

(21) Appl. No.: 14/985,279

(22) Filed: Dec. 30, 2015

(65) Prior Publication Data

US 2016/0300537 A1 Oct. 13, 2016

Related U.S. Application Data

(60) Provisional application No. 62/146,153, filed on Apr. 10, 2015.

(51) Int. Cl.
*G09G 3/34* (2006.01)
*G09G 3/20* (2006.01)

(52) U.S. Cl.
CPC ... *G09G 3/2092* (2013.01); *G09G 2320/0233* (2013.01); *G09G 2320/0271* (2013.01); *G09G 2320/0626* (2013.01); *G09G 2354/00* (2013.01); *G09G 2360/141* (2013.01); *G09G 2360/144* (2013.01); *G09G 2360/16* (2013.01); *G09G 2370/08* (2013.01)

(58) Field of Classification Search
CPC ..... G09G 3/2092; G09G 2320/0626; G09G 3/3406; G09G 3/3607; G09G 2320/103; G09G 2320/066; H04N 19/44; H04N 19/98; H04N 19/136; H04N 19/184; H04N 19/186; H04N 19/188
See application file for complete search history.

(56) References Cited

U.S. PATENT DOCUMENTS

| | | | | |
|---|---|---|---|---|
| 7,737,930 | B2 | 6/2010 | Inuzuka et al. | |
| 7,762,665 | B2 * | 7/2010 | Vertegaal | G06F 3/011 351/209 |
| 8,004,511 | B2 | 8/2011 | Kerofsky | |
| 8,207,932 | B2 | 6/2012 | Kerofsky | |
| 8,406,569 | B2 | 3/2013 | Segall et al. | |
| 8,605,017 | B2 | 12/2013 | Elliott et al. | |
| 8,695,031 | B2 * | 4/2014 | Kumar | G06Q 30/02 725/32 |

(Continued)

*Primary Examiner* — Jennifer Mehmood
*Assistant Examiner* — Sardis F Azongha
(74) *Attorney, Agent, or Firm* — Lewis Roca Rothgerber Christie LLP

(57) ABSTRACT

In a method of attenuating image brightness in a high dynamic range (HDR) display device, the method includes: receiving, by a processor, an incoming data stream comprising image data; detecting, by the processor, a trigger for attenuating a brightness level of a first image corresponding to the image data; generating, by the processor, output image data for a second image based on the first image, wherein the second image has a different average brightness level than the first image; and displaying, by the processor, the second image on the HDR display device.

18 Claims, 6 Drawing Sheets
(3 of 6 Drawing Sheet(s) Filed in Color)

(56) References Cited

U.S. PATENT DOCUMENTS

| | | | | |
|---|---|---|---|---|
| 8,761,580 | B2 * | 6/2014 | Gausereide | G11B 27/034 348/169 |
| 9,143,812 | B2 * | 9/2015 | Braness | H04N 21/23439 |
| 9,635,377 | B2 * | 4/2017 | Kim | H04N 19/463 |
| 2006/0164524 | A1 | 7/2006 | Shibano et al. | |
| 2014/0002479 | A1 | 1/2014 | Muijis et al. | |
| 2014/0044372 | A1 | 2/2014 | Mertens | |
| 2014/0210847 | A1 | 7/2014 | Knibbeler et al. | |
| 2014/0285531 | A1 * | 9/2014 | Dasher | G09G 5/10 345/690 |
| 2015/0046823 | A1 * | 2/2015 | Didomenico | G09G 5/14 715/722 |
| 2015/0245043 | A1 * | 8/2015 | Greenebaum | H04N 19/98 375/240.25 |

* cited by examiner

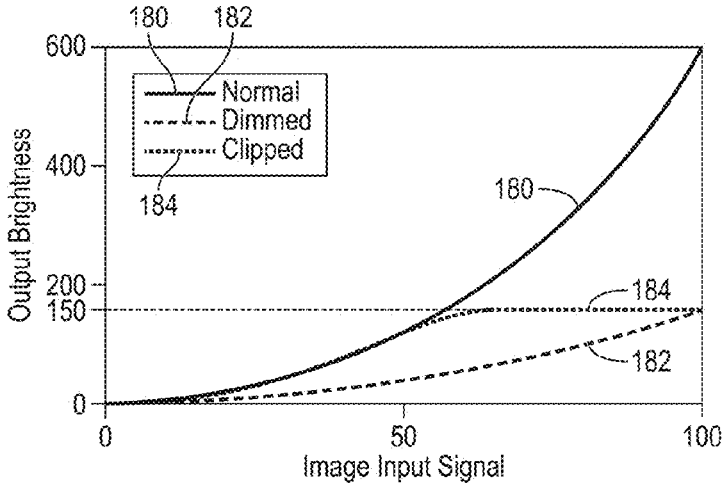
FIG. 4C
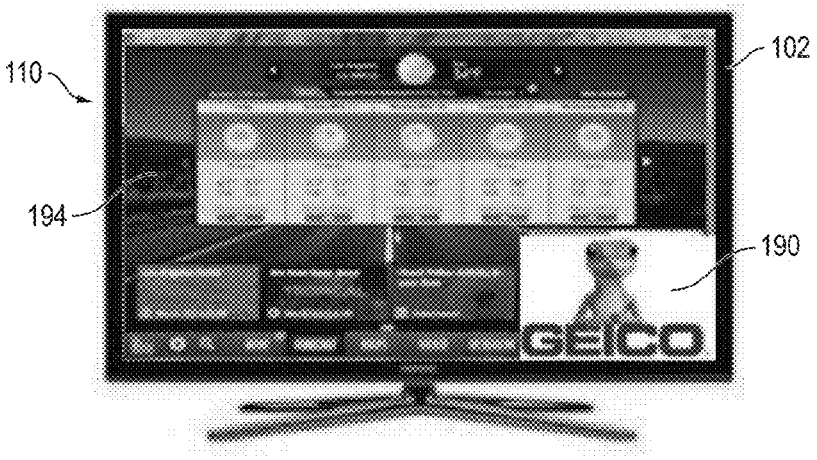
FIG. 4D
200
| Intermission Lighting | Dimming Mode | Dashboard Mode | Trigger |
|---|---|---|---|
| ☒ | ☐ | ☐ | Commercials (Content Metadata) |
| ☐ | ☒ | ☐ | (Night Protect) Scenes with >200 nit average brightness |
| ☐ | ☐ | ☒ | Remote Control Mute |
| ☒ | ☐ | ☐ | Smart Stay (Camera-based stand detect) |
| ☒ | ☐ | ☐ | Voice Command |
FIG. 5

METHOD AND APPARATUS FOR HDR ON-DEMAND ATTENUATION CONTROL

CROSS-REFERENCE TO RELATED APPLICATION

The present application claims priority to and the benefit of Provisional Application No. 62/146,153, filed on Apr. 10, 2015, entitled "A METHOD AND APPARATUS FOR HDR ON-DEMAND ATTENUATION CONTROL", the entire content of which is incorporated herein by reference.

BACKGROUND

1. Field

Embodiments of the present invention relate to a method and apparatus for High Dynamic Range (HDR) on-demand attenuation control.

2. Related Art

Display devices are capable of displaying images and video with higher resolution, picture quality, and brightness, than ever before. HDR display devices in particular are capable of displaying images with extremely high contrast ratios and highly accurate coloration. Such high quality display devices can lead to an improved and more immersive viewing experience in certain circumstances. At full brightness, however, an HDR display device may be capable of emitting the same amount of light as conventional room lighting. Thus, in certain circumstances, such as during very bright scenes or commercial breaks, the high brightness capabilities of HDR display devices may cause users to be uncomfortable or annoyed.

The above information disclosed in this Background section is only to enhance the understanding of the background of the invention, and therefore it may contain information that does not constitute prior art.

SUMMARY

Aspects of embodiments of the present invention relate to a method and apparatus for High Dynamic Range (HDR) on-demand attenuation control.

According to some embodiments of the present invention, in a method of attenuating image brightness in a high dynamic range (HDR) display device, the method includes: receiving, by a processor, an incoming data stream including image data; detecting, by the processor, a trigger for attenuating a brightness level of a first image corresponding to the image data; generating, by the processor, output image data for a second image based on the first image, wherein the second image has a different average brightness level than the first image; and displaying, by the processor, the second image on the HDR display device.

According to some embodiments, the detecting of the trigger includes: monitoring, by the processor, metadata of the incoming data stream; and identifying, by the processor, a change in a characteristic of the metadata corresponding to commercial break.

According to some embodiments, the detecting of the trigger includes: receiving, by the processor, an indicator from a sensor indicating a user-supplied input to request a subdued display mode.

According to some embodiments, the sensor is configured to receive a signal from a remote control operated by a user as the user-supplied input.

According to some embodiments, the sensor is configured to receive a voice command from a user as the user-supplied input.

According to some embodiments, the second image includes the first image such that the second image is dimmed compared to the first image.

According to some embodiments, the second image includes a composite of the first image and a third image, wherein the first image is located at a sub-region of a display area smaller than an entirety of the display area and the third image is located outside the sub-region.

According to some embodiments, the method farther includes retrieving, by the processor from a memory, the third image, wherein the third image has a different average brightness than the first image.

According to some embodiments, the method further includes retrieving, by the processor from an external source, an advertisement for display as the third image.

According to some embodiments, the detecting of the trigger includes: receiving, by the processor from a camera, an image of an environment in proximity to the HDR display device; and detecting, by the processor, a lack of user attentiveness based on the image of the environment.

According to some embodiments of the present invention, in a system for attenuating image brightness, the system includes: a processor; and a memory coupled to the processor, wherein the memory stores instructions that, when executed by the processor, cause the processor to: receive an incoming data stream including image data; detect a trigger for attenuating a brightness level of a first image corresponding to the image data; generate output image data for a second image based on the first image, wherein the second image has a lower brightness level than the first image; and transmit a signal to display the second image.

According to some embodiments, the instructions further cause the processor to: monitor metadata of the incoming data stream; and identifying, by the processor, a change in a characteristic of the metadata corresponding to commercial break.

According to some embodiments, the instructions further cause the processor to: receive an indicator from a sensor indicating a user-supplied input to request attenuation of the brightness level.

According to some embodiments, the sensor is configured to receive a signal from a remote control operated by a user as the user-supplied input.

According to some embodiments, the second image includes the first image such that the second image is dimmed compared to the first image.

According to some embodiments, the second image includes a composite of the first image and a third image, wherein the first image is located at a sub-region of a display area smaller than an entirety of the display area and the third image is located outside the sub-region.

According to some embodiments, the instructions further cause the processor to retrieve, from the memory, the third image, wherein the third image has a different average brightness than the first image.

According to some embodiments, the instructions further cause the processor to retrieve, from an external source, an advertisement for display as the third image.

According to some embodiments, the instructions further cause the processor to: receive, from a camera, an image of an environment in proximity to the HDR display device; and detect a lack of user attentiveness based on the image of the environment.

According to some embodiments of the present invention, a high dynamic range (HDR) display device includes: an HDR display panel; a processor coupled to the HDR display panel; and a memory coupled to the processor, wherein the memory stores instructions that, when executed by the processor, cause the processor to: receive an incoming data stream including image data; detect a trigger for attenuating a brightness level of a first image corresponding to the image data; generate output image data for a second image based on the first image, wherein the second image has a different brightness level than the first image; and display the second image on the HDR display panel.

BRIEF DESCRIPTION OF THE DRAWINGS

The patent or application file contains at least one drawing executed in color. Copies of this patent or patent application publication with color drawings will be provided by the Office upon request and payment of the necessary fee.

A more complete appreciation of the present invention, and many of the attendant features and aspects thereof, will become more readily apparent with reference to the following detailed description when considered in conjunction with the accompanying drawings in which like reference symbols indicate like components, wherein:

FIGS. 4A-4D illustrate further detail of a subdued presentation mode for video displayed by the HDR display device, according to some example embodiments of the present invention;

FIG. 5 illustrates an example user interface menu for controlling the attenuation mode of the attenuation control system, according to some example embodiments of the present invention.

DETAILED DESCRIPTION

Figure 1:
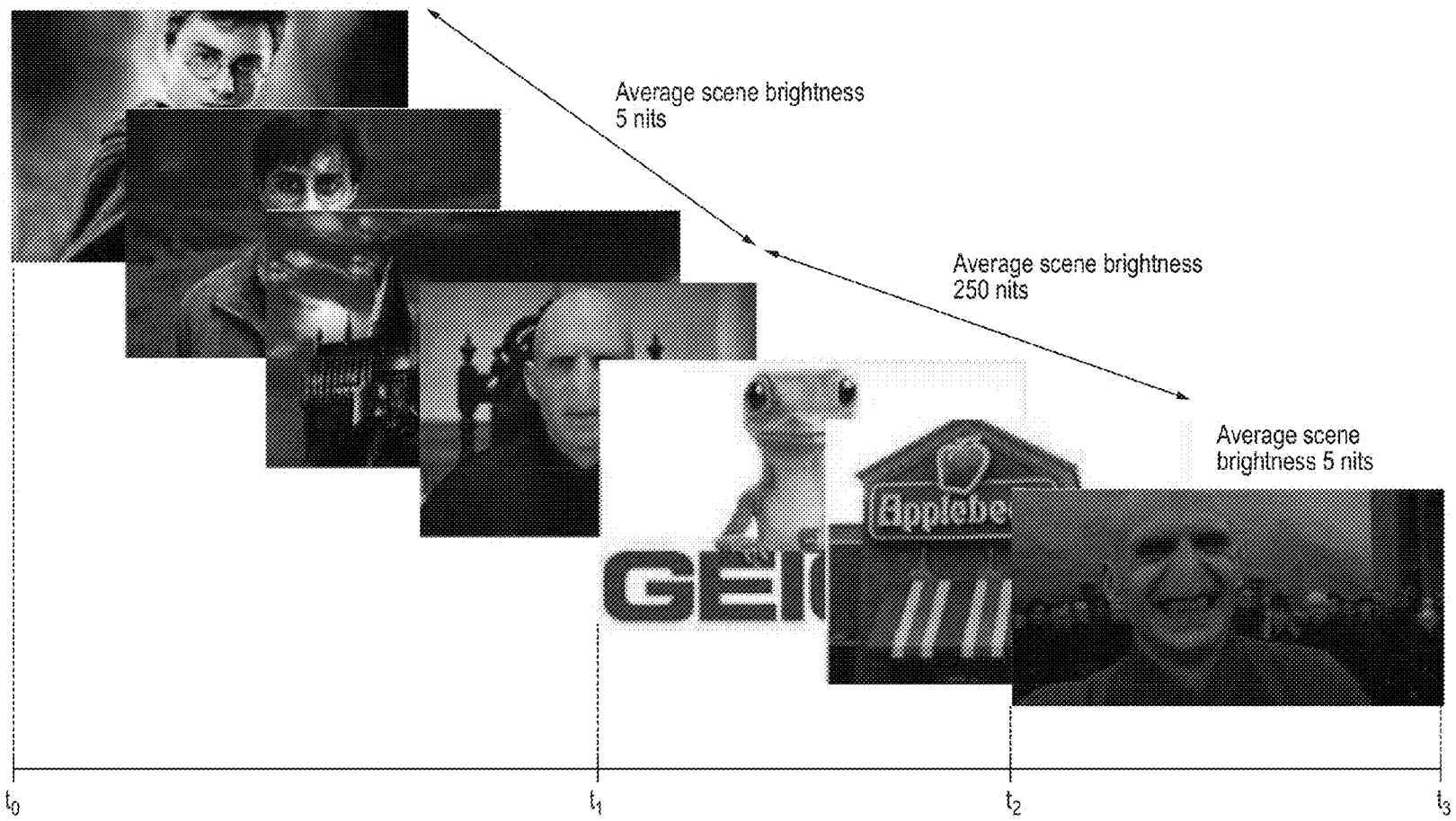
FIG. 1 illustrates an example scenario in which abrupt scene changes may be uncomfortable to viewers of an HDR display device.

Aspects and features of embodiments of the present invention and methods of accomplishing the same may be understood more readily by reference to the following detailed description of embodiments and the accompanying drawings.

Hereinafter, example embodiments will be described in more detail with reference to the accompanying drawings, in which like reference numbers refer to like elements throughout. The present invention may, however, be embodied in many different forms and should not be construed as being limited to the embodiments set forth herein. Rather, these embodiments are provided as examples so that this disclosure will be more thorough and more complete, and will more fully convey the aspects and features of the present invention to those skilled in the art. Accordingly, processes, elements, and techniques that are not necessary to those having ordinary skill in the art for a complete understanding of the aspects and features of the present invention may not be described.

Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, for example, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or component is referred to as being "on," "connected to," or "coupled to" another element or component, it can be directly on, connected to, or coupled to the other element or component, or one or more intervening elements or components may be present. In addition, it will also be understood that when an element or component is referred to as being "between" two elements or components, it can be the only element or component between the two elements or components, or one or more intervening elements or components may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic devices or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Some portions of the following detailed descriptions are presented in terms of algorithms and/or symbolic representations of operations on data bits that may occur within a computer/server memory. These descriptions and representations are used by those skilled in the art of data compression to convey ideas, structures, and methodologies to others skilled in the art. An algorithm is a self-consistent sequence for achieving a desired result and requiring physical manipulations of physical quantities, which may take the form of electro-magnetic signals capable of being stored, transferred, combined, compared, replicated, reproduced, and otherwise manipulated. Such signals may be referred to as bits, values, elements, symbols, characters, terms, numbers, or the like. These and similar terms are associated with appropriate physical quantities, and are used as representative labels for these quantities. Accordingly, terms such as "processing," "computing," "calculating," "determining," "displaying" or the like, refer to the action and processes of a computing device or system that manipulates data represented as physical quantities within registers/memories into other data that is also represented by stored/transmitted/displayed physical quantities.

Aspects of embodiments of the present invention relate to a method and apparatus for High Dynamic Range (HDR) on-demand attenuation control.

Display devices have become a ubiquitous part of modern life, and are found in many different electronic devices for conveying information and display images to users. As technology has progressed, so too has the ability to manufacture display devices with relatively smaller profiles and a wide range of screen sizes at relatively lower cost.

Today, display devices are larger and brighter than ever before. With the advent of high dynamic range (HDR) televisions, modern display devices with extremely high quality screen resolution, contrast ratio, and color range are expected to become commonplace.

The ability for HDR displays to display incredibly bright and high resolution images, with high contrast ratio and wide color range can lead to an improved viewing experience in many circumstances, but also can have a pronounced impact on room ambiance compared to non-HDR display devices. For example, a modern 65 inch HDR display device with a peak brightness of, for example, 1000 nits may potentially output an order of magnitude more light than a non-HDR 32 inch display that may have a peak brightness of, for example, 200 nits. In fact, when such HDR displays are operating at full brightness, the amount of light output may be able to light up an entire room in a way that would rival conventional room lighting.

When an HDR display commands the active attention of viewers, this ambiance may be desirable and lead to an immersive viewing experience. For example, because of the high contrast ratio of HDR displays images can be displayed in which a portion of the image (such as a star, a light bulb, or a flame) is very bright, but other portions of the image (such as shadows or the night sky) are simultaneously very dark. This improved contrast ratio compared to non-HDR display devices can enable content creators to generate images that are much more realistic and pleasurable to viewers.

On the other hand, when an HDR display is being largely ignored, for example, during a commercial break, or while the viewer is distracted by something in the room other than the displayed image, the combination of the large screen size and high brightness may have a non-negligible impact on room lighting and ambiance, in a way that may be inconvenient or annoying to viewers.

In other words, HDR images on a large screen display may exacerbate the impact of display lighting on the room in which the HDR display is located. For example, a dark and brooding HDR movie experience may be punctuated by commercial breaks with bright and colorful backgrounds that light up the room. Similarly, a commercial break in which there is a white or light-colored background and large foreground motion may cause large changes to the light level in a room.

Such dramatic changes in room lighting may be jarring and unappealing to viewers. For example, bright images on an HDR display may disrupt an individual viewer's adaptation to other content that is less bright, or may be uncomfortable to watch. Additionally, bright images may disrupt viewers' circadian rhythms and cause sleep disturbances.

The potential negative consequences of HDR technology may be exacerbated by current display trends. For example, viewers may sit relatively close to displays, in order to cause the display screen to cause the display to occupy a large portion of the viewer's field of view. In such circumstances, the display may become a dominant light source for the viewer, which may cause any negative consequences of the HDR display technology to be more prominent or amplified to the viewer.

Additionally, circumstances may arise in which a secondary display is utilized by viewers in conjunction with the primary HDR display, for example, by using a mobile phone, tablet, or laptop with a front facing camera that relies on light to function. A large and bright HDR display can operate as an effective light source for use with front-facing cameras. Highly volatile lighting conditions (arising, for example, from an abrupt scene change or an abrupt change from a feature film to a commercial break), however, may pose a difficult challenge for a camera's auto-exposure, auto-white balance, and auto-focus functionality.

Furthermore, such volatile lighting conditions can be annoying and uncomfortable to viewers and, as discussed, can be particularly pronounced in the context of HDR display devices. For example, FIG. 1 illustrates an example scenario in which abrupt scene changes may be uncomfortable to viewers of an HDR display device. As illustrated in FIG. 1, during the course of a dark and brooding feature film playing, for example, on a network television station from time $t_0$ to time $t_1$, the average scene brightness may be, for example, 5 nits. At time $t_1$, however, the network television station may interrupt the video stream of the feature film in order to display a series of commercials during a commercial break from time $t_1$ until time $t_2$. Because the content creators for network television commercials are likely not the same as the content creators for the feature film, there is unlikely to be any coordination with respect to abrupt changes in brightness. Additionally, content creators for network television commercials may desire to attract and maintain the attention of viewers with bright and captivating images. Thus, during the commercial break between time $t_1$ and time $t_2$, the average scene brightness may be, for example, 250 nits, which is significantly higher than the average brightness during the feature film. Then between time $t_2$ and time $t_3$, the television network may return to displaying the feature film, during which time the average brightness may again be only 5 nits.

As discussed, such wide fluctuations in screen brightness may be jarring to viewers. Furthermore, even without major variations in brightness, viewers of HDR display devices may find scenes and images that are particularly bright to be uncomfortable or annoying.

Accordingly, embodiments of the present invention include a method and apparatus for HDR on-demand attenuation control, in which certain characteristics of HDR displays may be improved, thereby providing a more pleasurable viewing experience.

Figure 2:
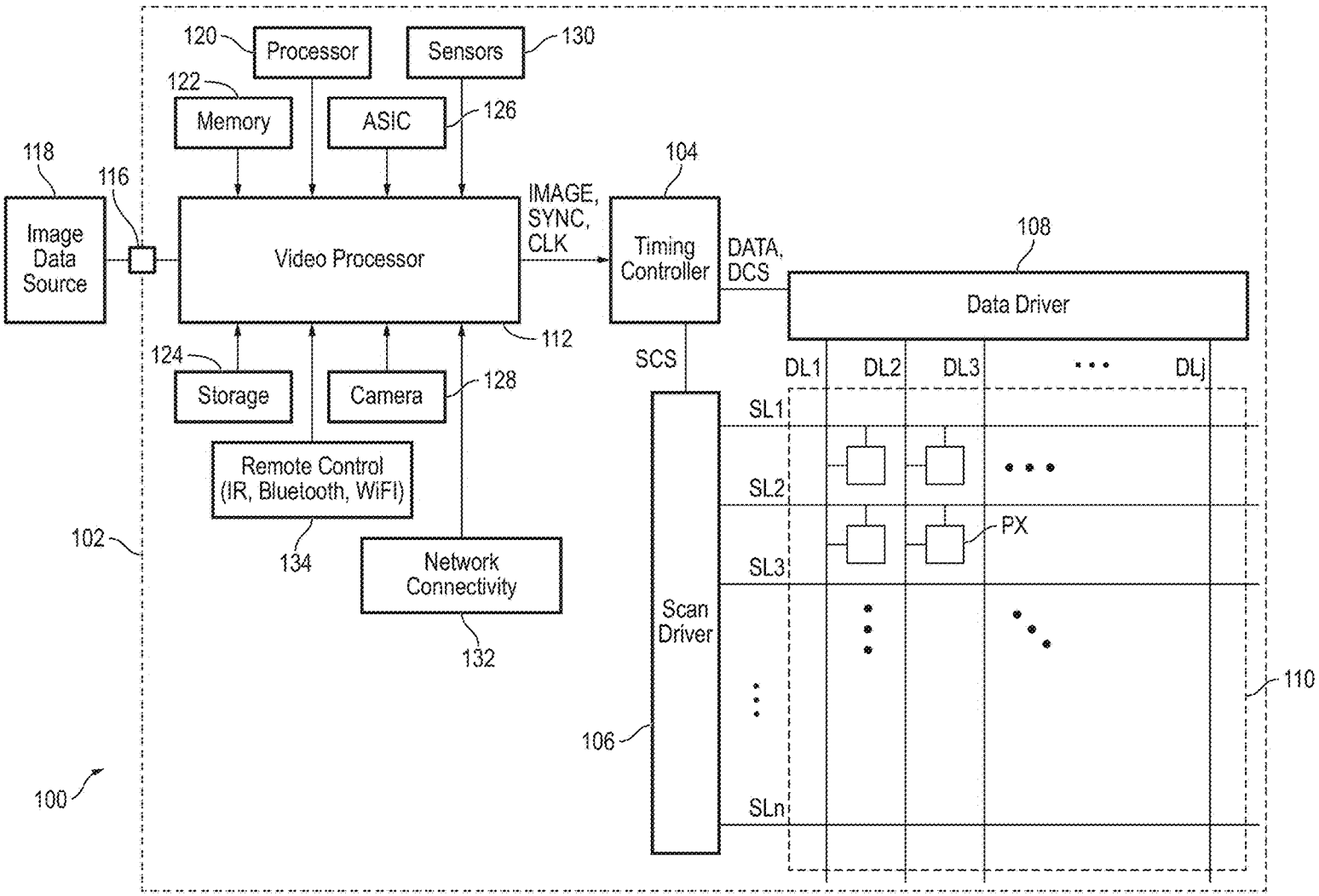
FIG. 2 illustrates an attenuation control system according to some example embodiments of the present invention.

FIG. 2 illustrates an attenuation control system 100 according to some example embodiments of the present invention. Referring to FIG. 2, the attenuation control system 100 includes a high dynamic range (HDR) display device 102. According to some embodiments of the present invention, the HDR display device 102 may be any suitable HDR display device such as, for example, a television, mobile device, tablet, personal computer, etc.

According to some embodiments of the present invention, the HDR display device 102 includes a timing controller 104, a scan driver 106, a data driver 108, and a plurality of pixels PX in a display area or display panel (e.g., an HDR display panel) 110. Each of the plurality of pixels PX is coupled to respective ones of scan lines SL1 to SLn, where n is a positive integer, and data lines DL1 to DLj, where j is a positive integer, at crossing regions of the scan lines SL1 to SLn and the data lines DL1 to DLj. Each of the pixels PX receives a data signal from the data driver 108 through the respective one of the data lines DL1 to DLj, when a scan signal is received from the scan driver 106 through a respective one of the scan lines SL1 to SLn.

The timing controller 104 receives an image signal IMAGE, a synchronization signal SYNC, and a clock signal CLK from a video processor (or video processor board) 112. According to some embodiments of the present invention, the video processor 112 and the timing controller 104 may be integrated into a single chip, or may be separate components electrically coupled to each other.

The timing controller 104 generates image data DATA, a data driver control signal DCS, and a scan driver control signal SCS. The synchronization signal SYNC may include a vertical synchronization signal and a horizontal synchronization signal. The timing controller 104 transmits the image data DATA and the data driver control signal DCS to the data driver 108, and transmits the scan driver control signal SCS to the scan driver 106.

The HDR display device 102 further includes a communication port 116, which is in electronic communication with an image data source 118 for sending and receiving data signals with other electronic devices. The image data source 118 may be any suitable image or video data source such as, for example, a radio frequency tuner, a cable or satellite content provider, an internal or external memory component (such as a digital video disk (DVD), etc.) storing image or video data, a streaming internet video service, or a data communications network. Accordingly, the image data source 118 operates to provide data (e.g., image or video data) for display by the HDR display device 102. The communication port 116 may be in electronic communication with the image data source 118 over any suitable medium of communication such as, for example, a telephone connection, satellite connection, cable connection, radio frequency communication, or any other suitable wired or wireless data communication mechanism.

The communication port 116 represents one or more electronic communication data ports capable of sharing input and output data with external devices. Communication port 116 can be configured to receive data cables with a wired interface such as high-speed Ethernet, Universal Serial Bus (USB), High-Definition Multimedia Interface (HDMI), Displayport, or other similar analog or digital data interface. Alternatively, communication port 116 may be configured to receive and transmit input and output (I/O) data wirelessly, for example, using available electromagnetic spectrum. The image data source may be an uncompressed video signal or a compressed signal that is decompressed by the video processor. The communication port 116 is in electronic communication with the video processor 112 for processing data received from the communication port 116 and other components of the HDR display device 102.

The HDR display device 102 further includes several other components interacting with the video processor 112 for facilitating display of images by the HDR display device 102. For example, the HDR display device 102 may include a processor or central processing unit (CPU) 120, which executes program instructions and interacts with other system components to perform various methods and operations according to embodiments of the present invention. Although the processor 120 is illustrated as being in electronic communication with the video processor 112, according to some embodiments of the present invention, the processor 120 and the video processor 112 may be integrated into the same chip or component. Additionally, while the processor 120 is illustrated in FIG. 2 as being directly connected to the video processor 112, as with each of the components of the HDR display device 102, the processor 120 may be directly connected to the video processor 112 or there may be additional intervening components. Furthermore, the processor 120 may be directly or indirectly (e.g., with intervening components) connected and in electronic communication with each of the other components of the HDR display device 102.

The HDR display device 102 further includes a memory 122, which operates as an addressable memory unit for storing software instructions to be executed by the processor 120 and/or the video processor 112. The memory 122 is implemented using any suitable memory device, such as a random access memory (RAM), and may additionally operate as a computer-readable storage medium having non-transitory computer readable instructions stored therein that, when executed by a processor, cause the processor to control the various components of the HDR display device 102, as will be discussed in more detail below.

The HDR display device 102 may further include a mass storage device or hard disk 124 electrically connected to the video processor 112 and/or the processor 120 for storing data files on non-volatile memory for future access by the video processor 112 and/or the processor 120. The mass storage device 124 may be any suitable mass storage device such as, for example, a hard disk drive (HDD), flash memory, secure digital (SD) memory card, compact disk, or digital video disk.

The HDR display device 102 may also include one or more application-specific integrated circuit (ASIC) chips 126 that are customized for specific uses or functionalities of the HDR display device 102.

Additionally, the HDR display device 102 may include one or more cameras 128 for capturing images of the environment in which the HDR display device 102 is located. According to some embodiments of the present invention, the cameras 128 may be any suitable digital camera component capable of capturing an image of the environment based on light in the visible or non-visible spectrum reflected from objects in the environment. The HDR display device 102 may further include additional sensors and/or receivers 130 configured to receive data from external sources. For example, according to some embodiments of the present invention, the sensors 130 may include an infrared (IR) sensor configured to receive signals from a device transmitting in the infrared spectrum of light, a short wavelength (e.g., Bluetooth®) receiver configured to receive signals from a device transmitting in a short wavelength protocol standard, a local area wireless networking (e.g., WiFi) receiver, or any other suitable sensor or receive capable of receiving (and/or transmitting) signals from (or to) external objects or electronic devices.

To that end, the HDR display device 102 may have network connectivity 132 for electronic or wireless communication (by way of the sensors 130 and/or the communication port 116) with one or more external components, for example, over a local area network or a wide area network (e.g., a public Internet). Additionally, the HDR display device 102 may be applied to an Internet of Things (IoT) architecture or system, in which various electronic devices (including the HDR display device 102) communicate with each other over a communication network to achieve results with minimum or very little human intervention or without any human intervention (e.g., non-men-in-the-loop).

Additionally, the HDR display device 102 may be configured to exchange (e.g., transmit and/or receive) information with a remote control 134. The remote control 134 may be any suitable external device such as a hand-held controller or mobile electronic device configured to enable a user of the HDR display device 102 to interact with or control the HDR display device 102, by transmitting signals to the HDR display device 102 (by way of the communication port 116 or the sensors 130).

As discussed above, during operation of an HDR display device (e.g., the HDR display device 102), because the maximum brightness levels of the display device may greatly exceed that of other non-HDR display devices, the comfort of viewers may be diminished in certain circumstances such as transitions from feature programming to a commercial break. Accordingly embodiments of the present invention include a system and method to enable on-demand attenuation control of HDR images or video.

Figure 3A:
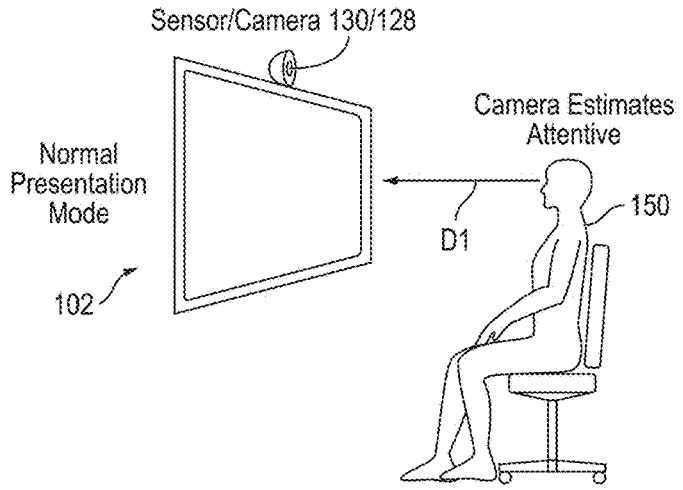
FIGS. 3A-3D illustrate various interfaces for enabling on-demand attenuation control of an HDR display device operating as part of the attenuation control system, according to some example embodiments of the present invention.

FIGS. 3A-3D illustrate various interfaces for enabling on-demand attenuation control of the HDR display device 102 operating as part of the attenuation control system 100. As discussed above, the HDR display device 102 may include a sensor 130 or camera 128 for detecting or capturing the behavior or circumstances of the external environment. For example, according to some embodiments of the present invention, as illustrated in FIG. 3A, the sensor 130 or the camera 128 mounted on or positioned near the display area of the HDR display device 102 may be configured to monitor or detect whether or not a viewer is actively engaged with or attentive to the HDR display device 102. According to some embodiments, the attenuation control system 100 (e.g., by way of the sensor 130 or camera 128, the video processor 112, and/or the processor 120) may determine that a user 150 is looking or facing in a direction D1 toward the display area 110 of the HDR display device 102 using any suitable technique known in the art such as detecting the relative orientation of various facial features of the user 150. In response to detecting the user 150 is facing toward or attentive to the HDR display device 102 (e.g., the user 150 is in an attentive state with respect to the image or video content being displayed by the HDR display device 102), the attenuation control system 100 may control the HDR display device 102 to display images or video data in a normal presentation mode, without any attenuation of the image or video brightness.

Additionally, according to some embodiments, the attenuation control system 100 (e.g., by way of the sensor 130 and/or camera 128, the video processor 112, and/or the processor 120) may measure or determine the ambient light level in the environment surrounding the attenuation control system 100, and attenuate or adjust the brightness of the output image (discussed in more detail below) in response to the measured ambient light level. For example, according to some embodiments, when the attenuation control system 100 determines that the ambient light level is relatively high or bright, the attenuation response may be less (e.g., the change in output image brightness may be lower) than when the ambient light level is relatively low or dim.

Figure 3B:
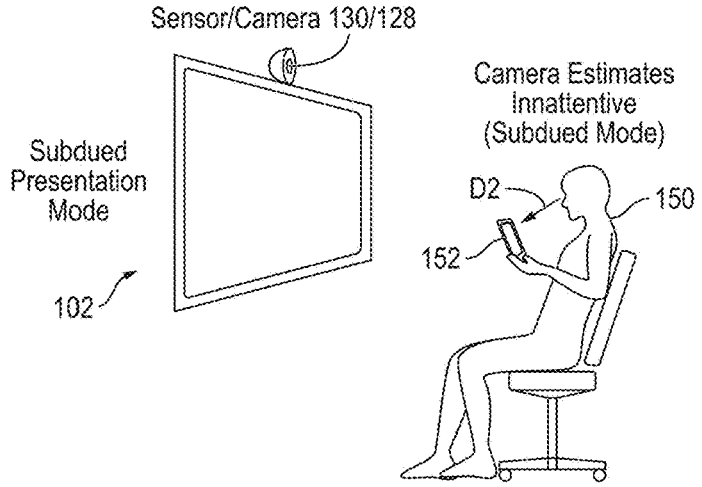
Figure 3C:
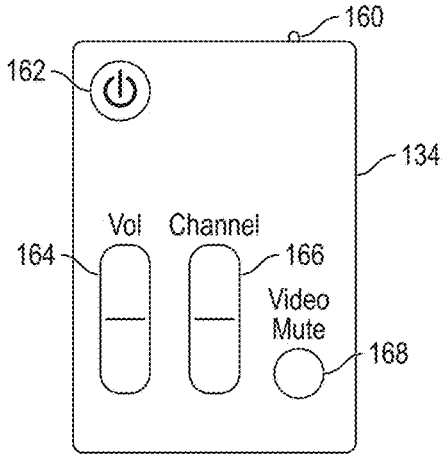

As illustrated in FIG. 3B, however, according to some embodiments of the present invention, the attenuation control system 100 (e.g., by way of the sensor 130 or camera 128, the video processor 112, and/or the processor 120) may determine at some point during operation of the HDR display device 102, that the user 150 is looking or facing in a direction D2 that is not toward the display area 110 of the HDR display device 102. Thus, the attenuation control system 100 may determine that the user 150 is in an inattentive state with respect to the image or video content being displayed by the HDR display device 102.

For example, the attenuation control system 100 may detect (e.g., by way of the sensor 130 or camera 128, the video processor 112, and/or the processor 120) that the user 150 is looking down at another object, such as a handheld mobile device 152 (such as a mobile cellular telephone, tablet or touch screen computer system, or laptop computer system), or is otherwise engaged in some distracting activity in the room such as participating in a telephone conversation or talking to another person in the room. According to some embodiments of the present invention, the handheld mobile device 152 may be in electronic communication with the HDR display device 102 (e.g., by way of a local area network, wide area network, or Internet of Things network connection), and may detect whether or not the user is looking at or distracted by the handheld mobile device 152, and may transmit a signal to the HDR display device 102 indicating the user 150 is in an inattentive state.

In response to determining that the user 150 is in an inattentive state with respect to the image or video content being displayed by the HDR display device 102, the attenuation control system 100 may control the HDR display device 102 to display images or video content in a subdued presentation mode. As will be discussed in more detail below, in the subdued presentation mode, the HDR display device 102 may attenuate the brightness of the images or video content such that the brightness of the light output by the HDR display device 102 is reduced compared to the normal presentation mode.

According to some embodiments of the present invention, the attenuation control system 100 may further include the remote control 134, which is a handheld electronic device external to the HDR display device 102 and is configured to transmit signals to the HDR display device 102 for control of the functionality of the HDR display device 102. For example, the remote control 134 may include an emitter (e.g., an infrared emitter) for transmitting signals to the sensor 130 or may be in electronic communication with the HDR display device 102 in a wired or wireless interface (e.g., over a local area network, wide area network, short wave communication, or Internet of Things network connection).

The remote control 134 may further include a plurality of buttons for interacting with and controlling the HDR display device 102, such as a power button 162 (for turning the HDR display device 102 on and off), a volume button 164 (for raising or lowering the volume of the audio signal emitted by the HDR display device 102), and one or more channel buttons 166 (for changing the channel tuning of the HDR display device 102). The remote control 134 may additionally include any other relevant buttons or physical hardware interface mechanisms for interacting with and controlling the HDR display device 102 according to the design and function of the attenuation control system 100. Finally, the remote control 134 may include a video mute button 168 for attenuating the brightness of light output by the HDR display device 102 and toggling the images or video displayed by the HDR display device 102 between the normal presentation mode and the subdued presentation mode.

According to some embodiments of the present invention, when a user (e.g., the user 150) presses or selects the video mute button 168, the remote control 134 may transmit a signal to the HDR display device 102 to toggle the presentation mode from the current mode to the alternative mode. That is, in certain circumstances such as a commercial break, or if the user wishes to change the lighting ambiance in the room in which the HDR display device 102 is located, the user may choose to press the video mute button 168 to toggle between the normal presentation mode and the subdued presentation mode.

If the current presentation mode is the normal presentation mode (in which the brightness of the light output by the HDR display device 102 is not reduced), the HDR display device 102 may switch to the subdued presentation mode in response to the user 150 selecting the video mute button 168. Alternatively, if the current presentation mode is the subdued presentation mode in which the light output by the HDR display device 102 is reduced compared to the normal presentation mode, the HDR display device may switch to the normal presentation mode in response to the user 150 selecting the video mute button 168.

According to some embodiments of the present invention, the remote control 134 may be a mobile display device (e.g., a smart phone or tablet computer) having a touch screen interface. In embodiments in which the remote control 134 has a touch screen interface, the video mute button 168 may be a graphical representation of a button or icon for toggling between the normal and subdued presentation modes.

Figure 3D:
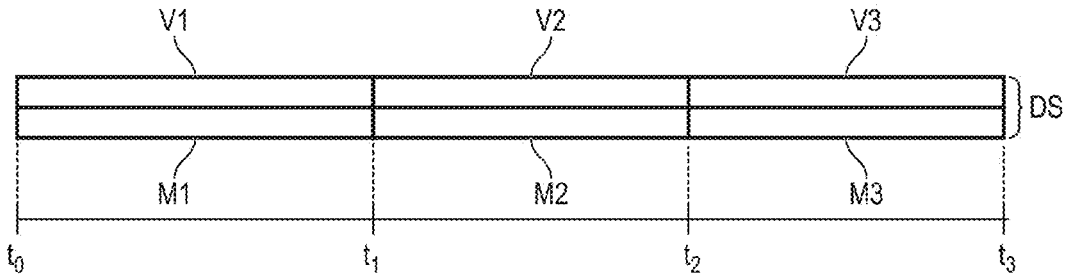

FIG. 3D illustrates an embodiment in which the attenuation control system 100 controls the HDR display device 102 to switch between the normal presentation mode and the subdued presentation mode based on the input data stream and the accompanying metadata. For example, networking television programming commonly includes a variety of metadata information encoded with the video presentation. Such metadata may include information that is part of the image raster data including fiducials or illuminated areas or marks in the overscan area of the image, or a network watermark displayed during the network programming that does not change throughout a program but is not present during commercial breaks. The metadata may further include frame-locked accompanying data such as closed-captioning data, network information, and/or video progress/status/elapse information transmitted with the video or image stream. Furthermore, the metadata may include information indicating that a commercial break is in progress, such as a timer indicating when the feature content will resume (e.g., "content resumes in xxx seconds), or may lack information included during the feature programming to indicate a commercial break is in progress.

Referring to FIGS. 1 and 3D, the HDR display device may receive (e.g., at the communication port 116) a data signal DS including the video signal to be displayed on the HDR display device 102 and as well as accompanying metadata encoded with the data signal DS. At time $t_0$, the data signal DS may include video/audio data V1 and metadata M1. The metadata M1 may include information, as discussed above, indicating that the video/audio data V1 is part of the featured programming. The attenuation control system 100 may monitor the metadata M1 and determine, based on the metadata M1, that the video/audio data V1 is part of the featured programming, and control the HDR display device 102 to display the video of the video/audio data V1 in the normal presentation mode (such that the brightness of the light emitted by the HDR display device 102 is not reduced).

The attenuation control system 100 may continue to monitor the data signal DS and, at time $t_1$, the HDR display device 102 may begin receiving video/audio data V2 and accompanying metadata M2, which correspond to programming for a commercial break. At time $t_1$, therefore, the attenuation control system 100 may monitor the metadata M2 and determine, based on the metadata M2, that the video/audio data V2 is not part of the featured programming (e.g., is part of a commercial break), and control the HDR display device 102 to display the video of the video/audio data V2 in the subdued presentation mode (such that the brightness of the light emitted by the HDR display device 102 is reduced).

The attenuation control system 100 may continue to monitor the data signal DS and, at time $t_2$, the HDR display device 102 may begin receiving video/audio data V3 and accompanying metadata M3, which again correspond to the featured programming (e.g., not a commercial break). At time $t_2$, therefore, the attenuation control system 100 may monitor the metadata M3 and determine, based on the metadata M3, that the video/audio data V3 is part of the featured programming (e.g., is not part of a commercial break), and control the HDR display device 102 to display the video of the video/audio data V3 in the normal presentation mode (such that the brightness of the light emitted by the HDR display device 102 is not reduced).

Thus, according to some embodiments of the present invention, the attenuation control system 100 may be configured to monitor the incoming data stream including the video and audio data and the corresponding metadata. The attenuation control system 100 may then be configured to determine and control, based on the metadata of the incoming data stream, whether or not to attenuate the brightness of the light output by the HDR display device 102.

Figure 4A:
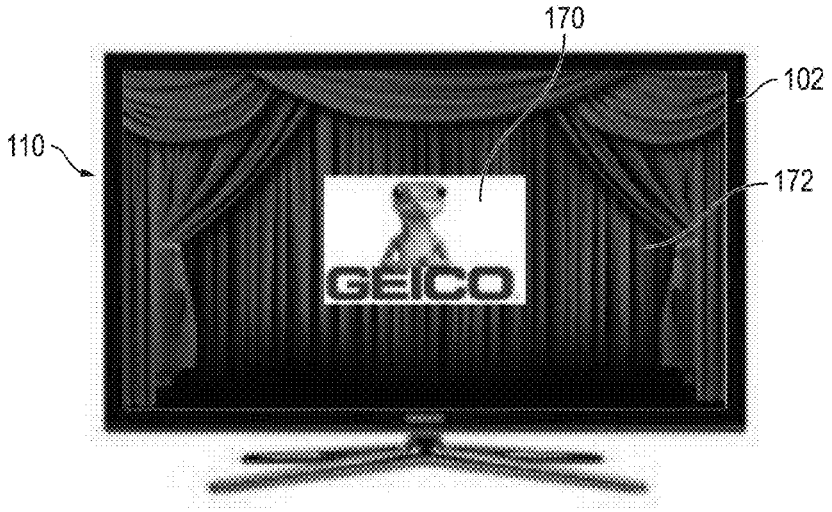
Figure 4B:
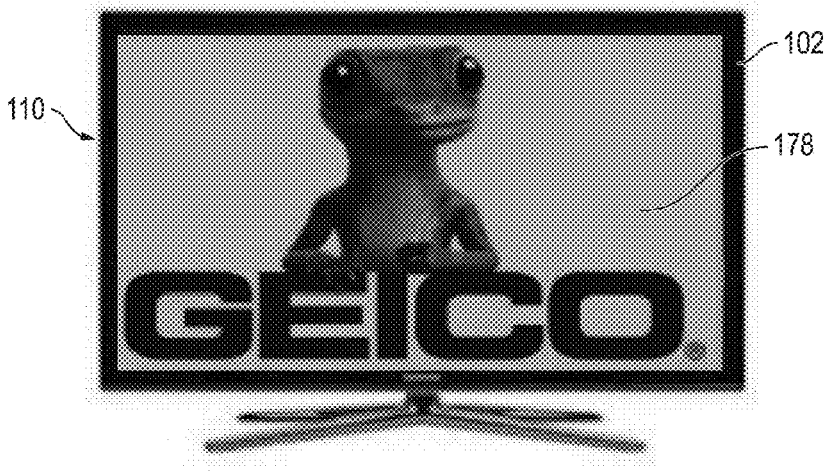

FIGS. 4A-4C illustrate further detail of a subdued presentation mode for video displayed by the HDR display device 102 according to some embodiments of the present invention. Referring to FIG. 4A, according to some embodiments of the present invention, in response to determining (e.g., as discussed above with respect to FIGS. 3A-3D) that the HDR display device 102 should display images or video in the subdued presentation mode, the attenuation control system 100 may control the HDR display device 102 to enter an "intermission" lighting mode.

The intermission lighting mode provides an option to control the HDR display device 102 to provide "intermission" lighting such that the lighting level or ambiance in the room is sufficient to enable the user to navigate through or see around the room, but is not so bright that it is uncomfortable or annoying to the user. Thus, according to some embodiments of the present invention, when the HDR display device 102 is operating in the intermission lighting mode, the user may not need to turn on additional lights in the room in order to see other objects in the room, but the user may also avoid the uncomfortable or annoying transition of wide variations in display lighting (e.g., as a result of a commercial break).

During the intermission lighting mode, the video or images from the incoming data stream may be displayed in a sub-region (e.g., a central portion or a peripheral portion of the display area 110) 170 that is smaller than the overall display area 110. Additionally, during the intermission lighting mode, the attenuation control system 100 may control the HDR display device 102 to display a largely static or relatively constant luminance background image at the region 172 of the display area 110 that is outside of the sub-region 170 (e.g., in a picture-in-picture arrangement). According to some embodiments of the present invention, the HDR display device 102 may cycle through one or more images that are stock or pre-selected, and which may be stored in memory (e.g., the memory 122 or the storage 124) or transferred to the HDR display device 102 from an external source (e.g., an electronic device in electronic communication with the HDR display device 102 by way of a local area network, wide area network, short wave communication, or Internet of Things network connection).

Because the sub-region 170 where the video for the incoming data stream is displayed is smaller than the overall display area 110, the impact to the lighting ambiance in the room caused by dramatic changes in brightness of the video of the incoming data stream may be reduced. Accordingly, during the intermission lighting mode, the attenuation control system 100 may operate to stabilize, and in some cases increase, the light output by the HDR display device 102 such that there is sufficient lighting to see objects in the room (e.g., to enable the user to navigate through the room during a commercial break without turning on another light). Scene cuts in the content (e.g., due to commercials), however, will have a significantly reduced impact on the overall room lighting. The intermission lighting mode, therefore, enables the HDR display device 102 to provide lighting during the subdued presentation mode that may be less harsh, uncomfortable, or annoying to viewers. According to some embodiments of the present invention, the image displayed in the region 172 may reduce or completely remove light within the blue spectrum of visible light, thereby reducing or minimizing impact to the user's circadian rhythm. Additionally, according to embodiments in which the sub-region 170 is small with respect to the peripheral region, an observer will be less likely to perceive flicker from the screen as the net light output of the screen over time will be largely stabilized by the mostly static peripheral region.

Referring to FIGS. 4B and 4C, according to some embodiments of the present invention, in response to determining (e.g., as discussed above with respect to FIGS. 3A-3D) that the HDR display device 102 should display images or video in the subdued presentation mode, the attenuation control system 100 may control the HDR display device 102 to enter a "dimmed" lighting mode in which the image or video 178 displayed on the display area 110 of the HDR display device 102 is dimmed (e.g., with a reduced brightness) compared to the normal presentation mode. By dimming the image or video displayed by the HDR display device 102, the impact on the room lighting ambiance from the light emitted by the HDR display device 102 may be reduced or mitigated.

As shown in FIG. 4C, the line 180 represents an example of the output brightness of the image signal during the normal operation mode. As shown in FIG. 4C, the maximum brightness of an HDR display device may be very high at 100% of output brightness. For the purposes of illustration, the HDR display device 102 may have a maximum brightness, for example, of 600 nits.

The line 182 represents an example of the output brightness of the image signal during the subdued presentation mode operating in the dimmed lighting mode. According to some embodiments, as illustrated by the line 182, the output brightness of the light emitted by the HDR display device 102 may be reduced or scaled down during the dimmed lighting mode. For example, the output brightness may be reduced or scaled down to a fraction of the output brightness during the normal operation mode.

As shown in FIG. 4C, for example, the output brightness of the HDR display device 102 may be 25% of the output brightness during the normal presentation mode (such that the maximum brightness during the dimmed lighting mode is only 150 nits compared to 600 nits during the normal presentation mode). Embodiments of the present invention are not limited to the output brightness during the dimmed lighting mode being 25% compared to the normal presentation mode, however, and the output brightness during the dimmed lighting mode may be any suitable amount according to the design and function of the attenuation control system 100.

For example, according to some embodiments of the present invention, the output light brightness may be in a range of 75% to 80% of the output light brightness in the normal presentation mode. According to some embodiments, the output light brightness may be in a range of 50% to 75% of the output light brightness in the normal presentation mode. Additionally, according to some embodiments, the output light brightness may be in a range of 25% to 50% of the output light brightness in the normal presentation mode. According to some embodiments of the present invention, the percentage or amount of reduced output light brightness may be a characteristic that can be modified or controlled by the user (e.g., by accessing a settings menu of a user-interface for the HDR display device 102). According to some embodiments, the attenuation control system 100 may utilize the sensor 130 or camera 128 to set the output light brightness. For example, the attenuation control system 100 may use the sensor 130 or the camera 128 to determine the ambient light level of the room and adjust the output brightness accordingly. For example, when a room is bright, a bright commercial may have little impact on a user's viewing experience. In this case, the attenuation control system 100 may set the brightness in a range of 75%-100%. Similarly, when a room is particularly dark, the effect of a bright commercial will be particularly high and the attenuation control system 100 may provide increased dimming and set the output light brightness in the range of 10%-25%. Accordingly, the attenuation control system 100 may provide dimming on a sliding scale according to the ambient lighting in the room.

According to some embodiments of the present invention, rather than reducing the overall brightness curve of the output light by a constant amount or percentage, the output light brightness may be clipped or capped at a threshold brightness level (e.g.; a predetermined threshold brightness level). The line 184 represents an example of the output brightness of the image signal during the subdued presentation mode operating in the dimmed lighting mode in which the output light brightness is clipped at a certain level (e.g., 150 nits) that is a certain percentage (e.g., a predetermined percentage) or fraction of the output light brightness in the normal presentation mode. As illustrated in FIG. 4C, the output light brightness may be clipped at 25% of the maximum output light brightness such that the output light brightness never exceeds 25% of the maximum output light brightness. Embodiments of the present invention are not limited to the output brightness during the clipped lighting mode being 25% compared to the normal presentation mode, however, and the output brightness during the clipped lighting mode may be any suitable amount according to the design and function of the attenuation control system 100, including the ranges discussed above with respect to the dimmed lighting mode. In addition to a clipping, any other tone mapping function that applies nonlinear attenuation of the highlights may be used to reduce the image artifacts associated with a hard clipping.

According to some embodiments of the present invention, light fluctuation during the dimmed and clipped lighting modes may be reduced by raising the black level of the images displayed by the HDR display device 102. Additionally, the images displayed by the HDR display device 102 may be tone mapped to provide a less hash output by limiting dynamic range and contrast (e.g., by performing gamma adjustments according to any suitable technique known in the art).

Referring to FIG. 4D, according to some embodiments of the present invention, in response to determining (e.g., as discussed above with respect to FIGS. 3A-3D) that the HDR display device 102 should display images or video in the subdued presentation mode, the attenuation control system 100 may control the HDR display device 102 to enter a "dashboard" lighting mode, whereby the HDR display device 102 is configured to display infotainment features during the subdued presentation made.

During the dashboard lighting mode, the video or images from the incoming data stream may be displayed in a sub-region 190 that is smaller than the overall display area 110, similar to the intermission lighting mode discussed above. Additionally, during the dashboard lighting mode, the attenuation control system 100 may control the HDR display device 102 to display information or infotainment data at the region 942 of the display area 110 that is outside of the sub-region 190. According to some embodiments of the present invention, the HDR display device 102 may be in electronic communication with an external source (e.g., by way of a local area network, wide area network, short wave communication, or Internet of Things network connection) for receiving information or infotainment to display in the sub-region 190.

For example, according to some embodiments, the HDR display device 102 may be in electronic communication with a device or cloud-based service providing entertainment offerings such as news, weather, trivia, music, videos, etc., to provide additional entertainment and/or information to the viewer during the subdued presentation mode. Additionally, according to some embodiments, the HDR display device 102 may be in electronic communication with a device or cloud-based service providing various advertisements for products or services of businesses in the commerce system. Such advertisements may be targeted to users based on users' viewing history or the programming currently being watched.

Additionally, the HDR display device 102 may display information stored on an electronic device (e.g., a mobile electronic device operated by the user 150) or an Internet of Things device connected to the HDR display device 102. That is, according to some embodiments of the present invention, the user 150 may be enabled to interact with additional electronic devices that are in electronic communication with the HDR display device 102 during the dashboard lighting mode.

FIG. 5 illustrates an example user interface menu 200 for controlling the attenuation mode of the attenuation control system 100 according to some embodiments of the present invention. According to some embodiments of the present invention, the user interface menu 200 may be accesses, for example, by way of a setup or settings menu of the HDR display device 102. The user interface menu 200 may include, for example, a column of options for triggering each of the various subdued presentation modes. For example, the user interface menu 200 may include an intermission lighting mode column, a dimming mode column, and a dashboard mode column. The user interface menu 200 may further list one or more triggers, for which the user can select from among the various subdued presentation mode columns.

For example, the triggers may include: identifying a commercial break based on the incoming data stream metadata; identifying scenes with greater than a certain threshold (e.g., a predetermined threshold) of average brightness (e.g., greater than 200 nits); identifying selection of a video mute button; identifying user attentiveness (e.g., by monitoring the direction that user is facing, whether or not the user is standing or sitting, whether or not the user is attentive to the displayed content, etc.); identifying a voice command (e.g., detected by the sensor 130) from the user requesting the subdued presentation mode; identifying proximity or lack of proximity to an external Internet of Things controller or Internet of Things network-connected devices (such as a phone or watch); and detecting an event (e.g., a predetermined event) occurring in the environment or proximity of the HDR display device such as phone call or doorbell. Embodiments of the present invention are not limited to the above-listed triggers, however, and may include any additional or alternative suitable triggers for initiating the subdued presentation mode according to the design and function of the attenuation control system 100.

Figure 6:
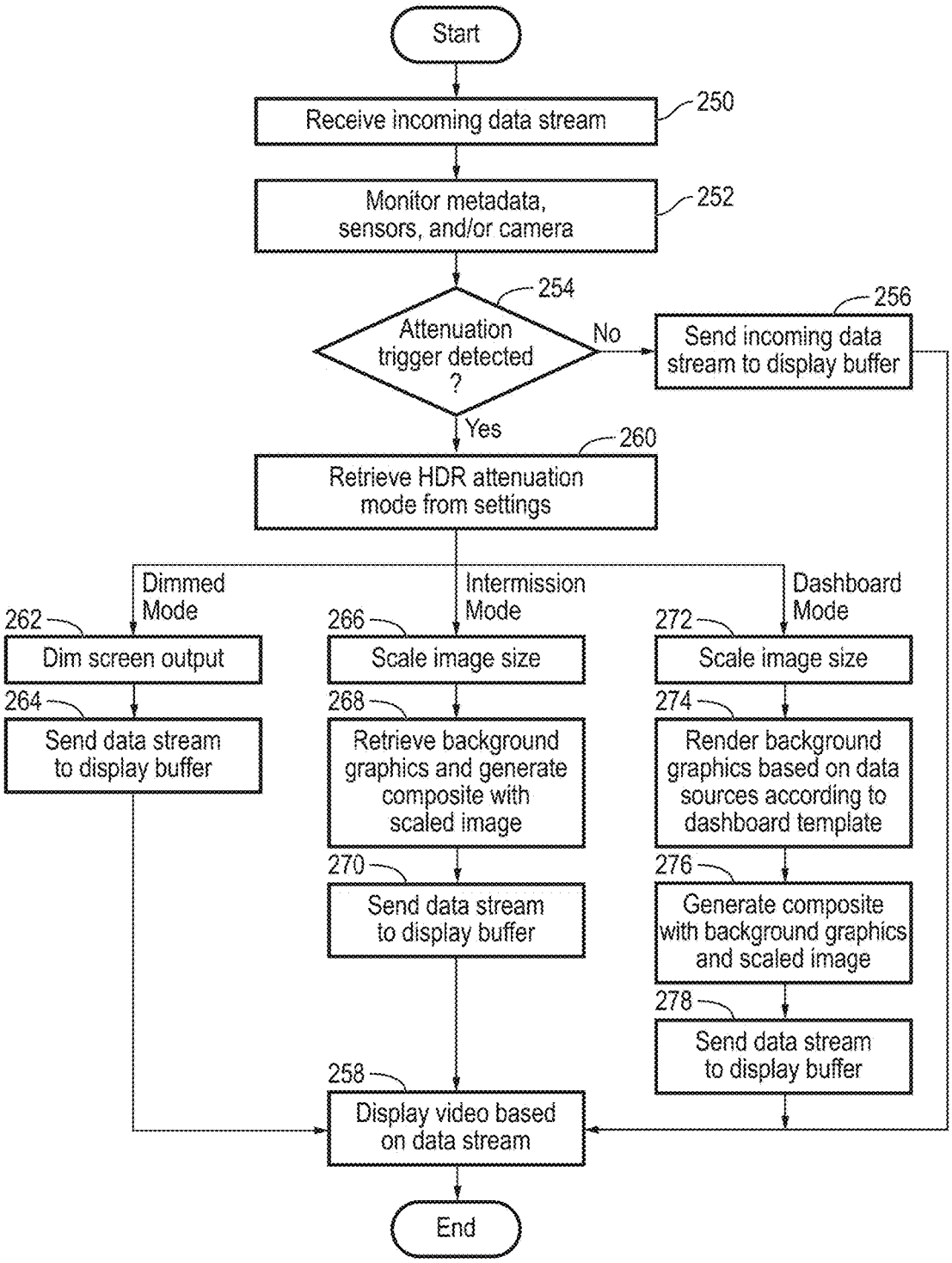
FIG. 6 is a flow diagram illustrating a method for on-demand attenuation control by the attenuation control system of the HDR display device, according to some example embodiments of the present invention.

FIG. 6 is a flow diagram illustrating a method for on-demand attenuation control by the attenuation control system of an HDR display device, according to some example embodiments of the present invention. While FIG. 6 illustrates aspects of example embodiments of the present invention, according to some embodiments of the present invention, the relative order of the operations described in FIG. 6 may be modified, and/or certain operations may be omitted and additional operations may be added, all without departing from the spirit and scope of the present invention. Additionally, referring to FIG. 6, the attenuation control method of the present invention may be performed by processing logic that may include hardware (e.g., circuitry, dedicated logic, etc.), firmware, software (such as that which is run on a computer system or processor, such as the video processor 112 and/or the processor 120), or a combination thereof, as will be understood by one of ordinary skill in the art.

The process starts and, at operation 250, the attenuation control system receives an incoming data stream from an external source (e.g., a radio frequency tuner, a cable or satellite content provider, an internal or external memory component such as a DVD storing the incoming data stream data, or a data communications network). The incoming data stream may include video or image data, audio data, as well as metadata corresponding to the image and audio data.

According to some embodiments of the present invention, at operation 252, the attenuation control system monitors metadata of the incoming data stream, and data collected or captured by the sensors and/or cameras of the HDR display device (e.g., the sensors 130 and/or the camera 128 of the HDR display device 102).

Next, at operation 254, the attenuation control system determines whether or not an attenuation trigger is detected. That is, the attenuation control system may detect a circumstance in which the displayed images should be displayed in a subdued presentation mode instead of a normal presentation mode. For example, as discussed above, the attenuation control system may determine, based on metadata of the incoming data stream, a user input (e.g., by way of a remote control), a voice command, user inattentiveness, etc., that the brightness of the images displayed on the HDR display device of the attenuation control system should be reduced.

If, at operation 254, the attenuation control system does not detect an attenuation trigger, the attenuation control system may proceed, at operation 256, to send the incoming data stream to a display buffer of the HDR display device without attenuating the brightness of the images. Then, the attenuation control system may proceed to operation 258, at which point the attenuation control system may display, on the HDR display device, the video or images from the display buffer of the HDR display device. Accordingly, in some embodiments, when the attenuation control system does not detect an attenuation trigger, the images or video of the incoming data stream may be displayed without any attenuation or reduction in the brightness of the images.

Returning to operation 254, however, if an attenuation trigger is detected, the attenuation control system may proceed, at operation 260, to retrieve the HDR attenuation mode. According to some embodiments of the present invention, the HDR attenuation mode may be a feature or setting that can be modified or controlled by the user, as discussed above with respect to FIG. 5, through a settings menu user interface. By contrast, according to another embodiment, the HDR attenuation mode may be preprogrammed or preset such that the HDR attenuation mode is not configurable by the user. The HDR attenuation mode, however, may be predetermined or preset, and the proper HDR attenuation mode may be determined based on various circumstances as discussed above (e.g., with respect to FIG. 5).

If, at operation 260, the attenuation control system determines that the HDR attenuation mode is a dimmed mode, the attenuation control system may proceed, at operation 262, to dim the screen output brightness of the HDR display device. For example, as discussed above, the attenuation control system may modify the brightness of the images or video from the incoming data stream such that it is reduced to a certain percentage or fraction of the normal (e.g., unmodified) brightness. According to another embodiment of the present invention, the attenuation control system may clip the brightness output at a certain percentage or fraction of the normal brightness, such that the brightness is not modified below a preset level after which point the brightness is attenuated such that it does not exceed the threshold level. Then, at operation 264, the attenuation control system sends the dimmed image or video data stream to the display buffer of the HDR display device, and proceeds to operation 258 by displaying the dimmed image or video stream on the HDR display device.

Returning to operation 260, if the attenuation control system determines that the HDR attenuation mode is an intermission mode, the attenuation control system may proceed, at operation 266, to scale the size of the image or video to correspond to a reduced area or sub-region of the display panel of the HDR display device. Then, at operation 268, the attenuation control system may retrieve background graphics (e.g., one or more background images) for the remainder of the display area (e.g., the portion of the display panel outside the periphery of the sub-region where the data stream video is displayed). As discussed above, the background graphics may include one or more images with an average brightness level that is relatively low (e.g., compared to that of the images or video of the incoming data stream). The background graphics may also include one or more images with an average brightness that is fairly bright such that they can provide functional lighting in the room. The attenuation control system may then generate a composite image that includes the background graphics and the scaled image or video from the incoming data stream. At operation 270, the attenuation control system may then send the composite image data stream to the display buffer of the HDR display device. Next, the attenuation control system again proceeds to operation 258 to display the composite image data stream on the HDR display device.

If, at operation 260, the attenuation control system determines that the HDR attenuation mode is a dashboard mode, the attenuation control system may proceed, at operation 272, to scale the size of the image or video to correspond to a reduced area or sub-region of the display panel of the HDR display device. Then, at operation 274, the attenuation control system may render background graphics (e.g., one or more background images) for the remainder of the display area (e.g., the portion of the display panel outside the periphery of the sub-region where the data stream video is displayed). For example, the attenuation control system may retrieve (e.g., from internal memory or an external device) various types of infotainment or advertisements, as discussed above, to display as part of the background graphics. The attenuation control system may then generate a composite image, at operation 276, that includes the background graphics and the scaled image or video from the incoming data stream. At operation 278, the attenuation control system may then send the composite image data stream to the display buffer of the HDR display device. Next, the attenuation control system again proceeds to operation 258 to display the composite image data stream on the HDR display device.

Accordingly, as described above, embodiments of the present invention provide an apparatus and method for enabling on-demand attenuation for the brightness of images displayed by an HDR display device. For example, an attenuation control system according to embodiments of the present invention may detect a trigger for attenuating the brightness, and modify the images or video of an incoming data stream such that the average brightness is reduced compared to the normal presentation mode (e.g., in which the brightness of the images or video is not reduced).

While this disclosure has been described in connection with what is presently considered to be practical example embodiments of the present invention, it is to be understood that the present invention is not limited to the disclosed embodiments, but, on the contrary, is intended to cover various suitable modifications and equivalent arrangements included within the spirit and scope of the appended claims and their equivalents.

What is claimed is:

1. A method of attenuating image brightness in a high dynamic range (HDR) display device, the method comprising:

receiving, by a processor, an incoming video data stream comprising image data;

detecting, by the processor, a trigger from the incoming video data stream for attenuating a brightness level of a first image corresponding to the image data, wherein the trigger is indicative of a commercial break;

generating, by the processor, output image data for a second image based on the first image, wherein the second image has a lower average brightness level than the first image; and displaying, by the processor, the second image on the HDR display device.

2. The method of claim 1, wherein the detecting of the trigger comprises:

monitoring, by the processor, metadata of the incoming video data stream; and identifying, by the processor, a change in a characteristic of the metadata corresponding to the commercial break.

3. The method of claim 1, wherein the detecting of the trigger further comprises:

receiving, by the processor, an indicator from a sensor indicating a user-supplied input to request a subdued display mode.

4. The method of claim 3, wherein the sensor is configured to receive a signal from a remote control operated by a user as the user-supplied input.

5. The method of claim 3, wherein the sensor is configured to receive a voice command from a user as the user-supplied input.

6. The method of claim 1, wherein the second image comprises a composite of the first image and a third image, wherein the first image is located at a sub-region of a display area smaller than an entirety of the display area and the third image is located outside the sub-region.

7. The method of claim 6, further comprising retrieving, by the processor from a memory, the third image, wherein the third image has a different average brightness than the first image.

8. The method of claim 6, further comprising retrieving, by the processor from an external source, an advertisement for display as the third image.

9. The method of claim 1, wherein the detecting of the trigger further comprises:

receiving, by the processor from a camera, an image of an environment in proximity to the HDR display device; and detecting, by the processor, a lack of user attentiveness based on the image of the environment.

10. A system for attenuating image brightness, the system comprising:

a processor; and a memory coupled to the processor, wherein the memory stores instructions that, when executed by the processor, cause the processor to:

receive an incoming video data stream comprising image data;

detect a trigger for attenuating a brightness level of a first image corresponding to the image data, wherein the trigger corresponds to a commercial break;

generate output image data for a second image based on the first image, wherein the second image has a lower average brightness level than the first image; and transmit a signal to display the second image.

11. The system of claim 10, wherein the instructions further cause the processor to:

monitor metadata of the incoming video data stream; and identifying, by the processor, a change in a characteristic of the metadata corresponding to the commercial break.

12. The system of claim 10, wherein the instructions further cause the processor to:

receive an indicator from a sensor indicating a user-supplied input to request attenuation of the brightness level.

13. The system of claim 12, wherein the sensor is configured to receive a signal from a remote control operated by a user as the user-supplied input.

14. The system of claim 10, wherein the second image comprises a composite of the first image and a third image, wherein the first image is located at a sub-region of a display area smaller than an entirety of the display area and the third image is located outside the sub-region.

15. The system of claim 14, wherein the instructions further cause the processor to retrieve, from the memory, the third image, wherein the third image has a different average brightness than the first image.

16. The system of claim 14, wherein the instructions further cause the processor to retrieve, from an external source, an advertisement for display as the third image.

17. The system of claim 10, wherein the instructions further cause the processor to:

receive, from a camera, an image of an environment in proximity to an HDR display device; and detect a lack of user attentiveness based on the image of the environment.

18. A high dynamic range (HDR) display device comprising:

an HDR display panel;

a processor coupled to the HDR display panel; and a memory coupled to the processor, wherein the memory stores instructions that, when executed by the processor, cause the processor to:

receive an incoming video data stream comprising image data;

detect a trigger for attenuating a brightness level of a first image corresponding to the image data, wherein the trigger corresponds to a commercial break;

generate output image data for a second image based on the first image, wherein the second image has a lower average brightness level than the first image; and display the second image on the HDR display panel.

* * * * *